US007172074B2

(12) United States Patent
Bittencourt

(10) Patent No.: US 7,172,074 B2
(45) Date of Patent: Feb. 6, 2007

(54) CONCENTRATION/CALCINATION PROCESS OF ZINC SILICATED MINERALS AND CONCENTRATE ZINC SILICATE BASED PRODUCT

(75) Inventor: Julio Cesar Bittencourt, Belo Horizonte (BR)

(73) Assignee: Compamhia Mineira de Metais, Brasilia (BR)

( * ) Notice: Subject to any disclaimer, the term of this patent is extended or adjusted under 35 U.S.C. 154(b) by 513 days.

(21) Appl. No.: 10/466,978

(22) PCT Filed: Nov. 29, 2001

(86) PCT No.: PCT/BR01/00148

§ 371 (c)(1),
(2), (4) Date: Nov. 13, 2003

(87) PCT Pub. No.: WO02/059386

PCT Pub. Date: Aug. 1, 2002

(65) Prior Publication Data

US 2004/0081603 A1 Apr. 29, 2004

(30) Foreign Application Priority Data

Jan. 24, 2001 (BR) ..... 0100348

(51) Int. Cl.
*B03B 9/00* (2006.01)
*B03B 7/00* (2006.01)
*B03D 1/02* (2006.01)

(52) U.S. Cl. ..... 209/164; 209/12.1; 209/17; 209/166; 209/3; 423/99; 423/109

(58) Field of Classification Search ..... 209/164, 209/166, 12.1, 17, 3; 423/99, 109
See application file for complete search history.

(56) References Cited

U.S. PATENT DOCUMENTS 4,253,614 A * 3/1981 McGarry et al. ..... 241/16

* cited by examiner

*Primary Examiner*—Thomas M. Lithgow
(74) *Attorney, Agent, or Firm*—Wood, Herron & Evans, LLP

(57) ABSTRACT

A concentration process of zinc silicated minerals, particularly willemite and calamine concentration, by single operations, or conventional steps of ore treatment, some of which include the following: Preparation of stockpiles of different mineralogical and contents compositions, crushing, screening, storage, dense separation, washing, homogenization, magnetic separation, grinding, classification, rubbing, conditioning, flotation, thickening, filtering, calcination, storage and waste deposition.

43 Claims, 4 Drawing Sheets

Calamine Process - block diagram

Figure 4:
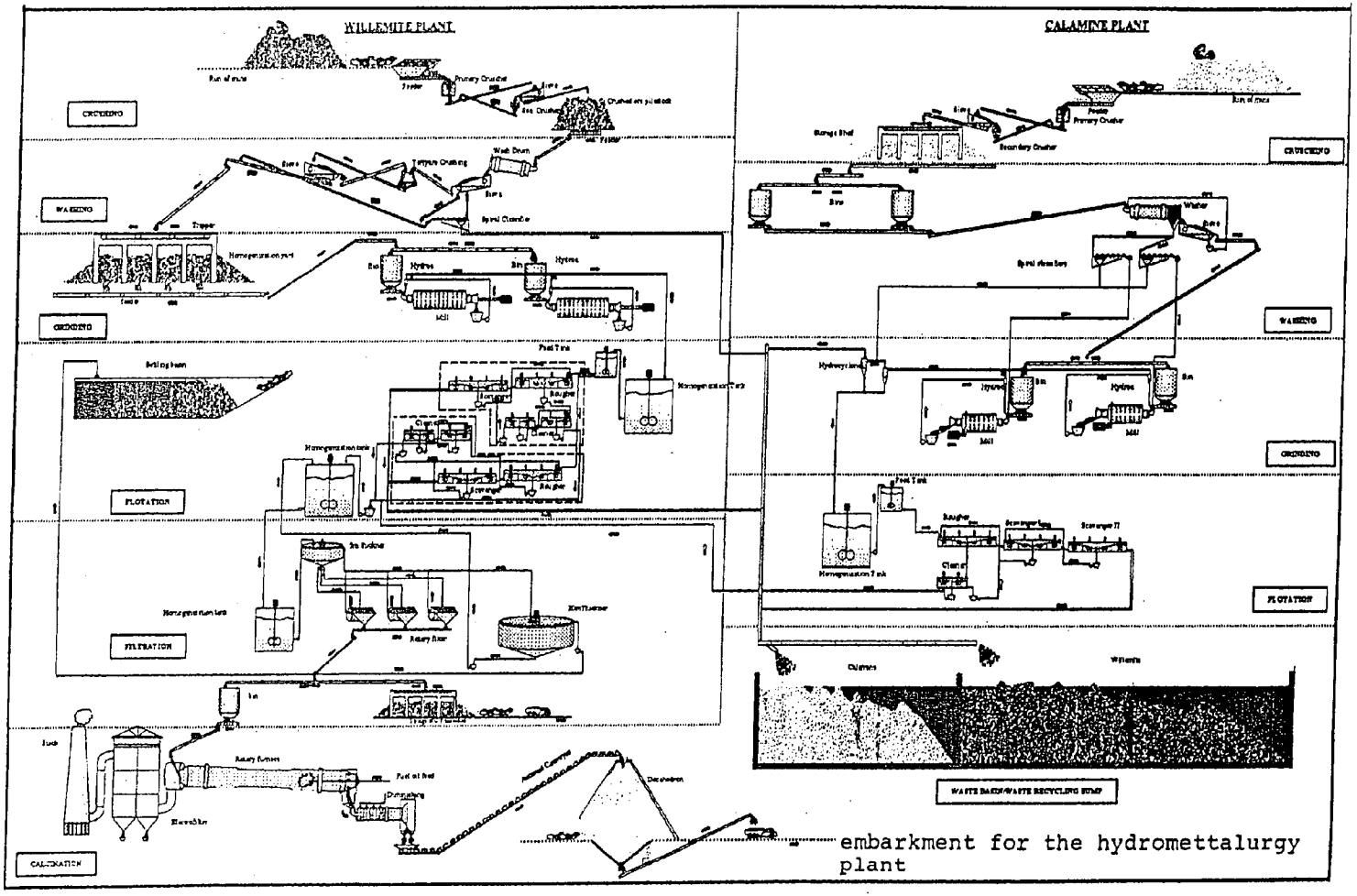

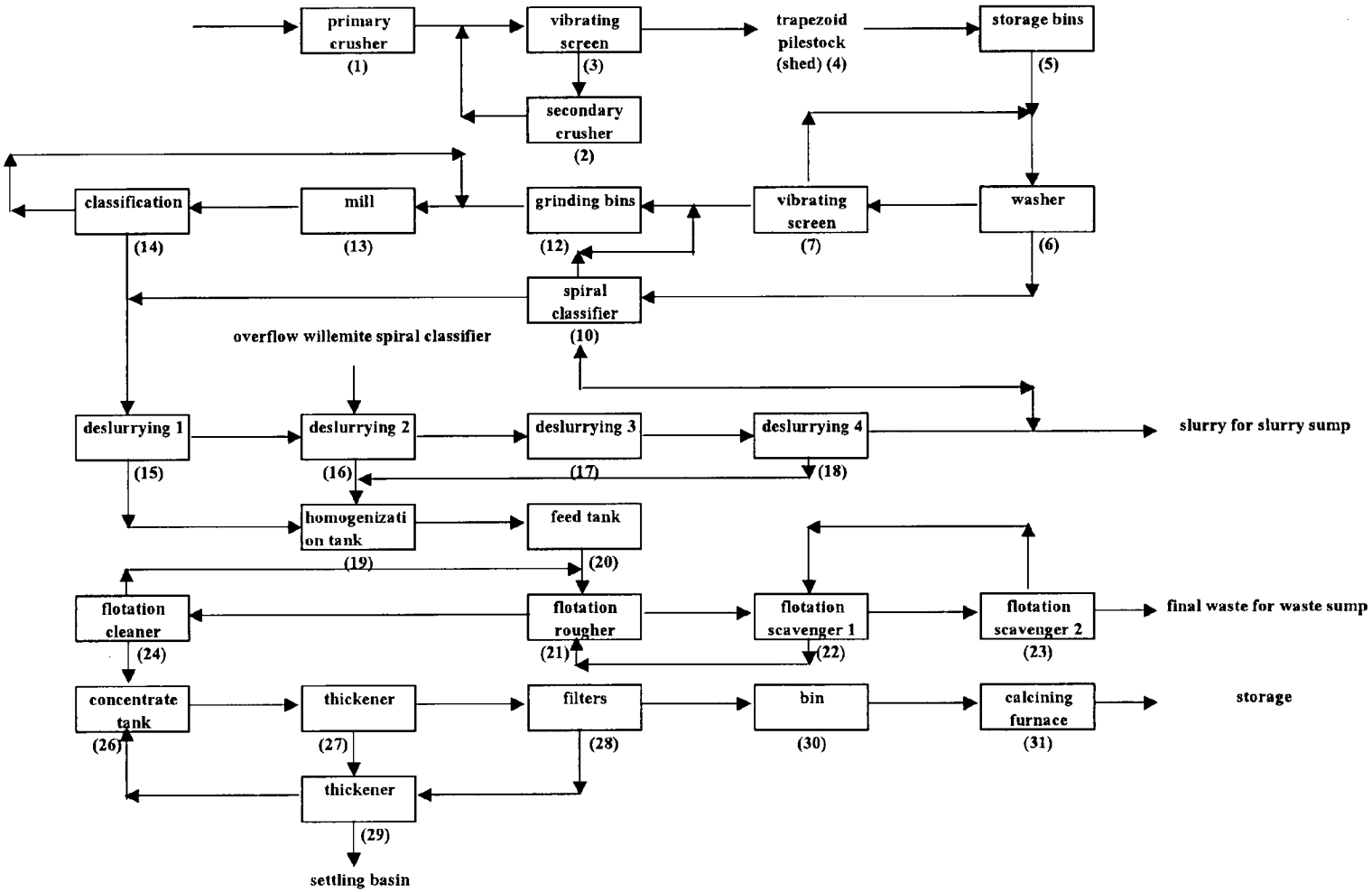
Figure 1 - Calamine Process - block diagram

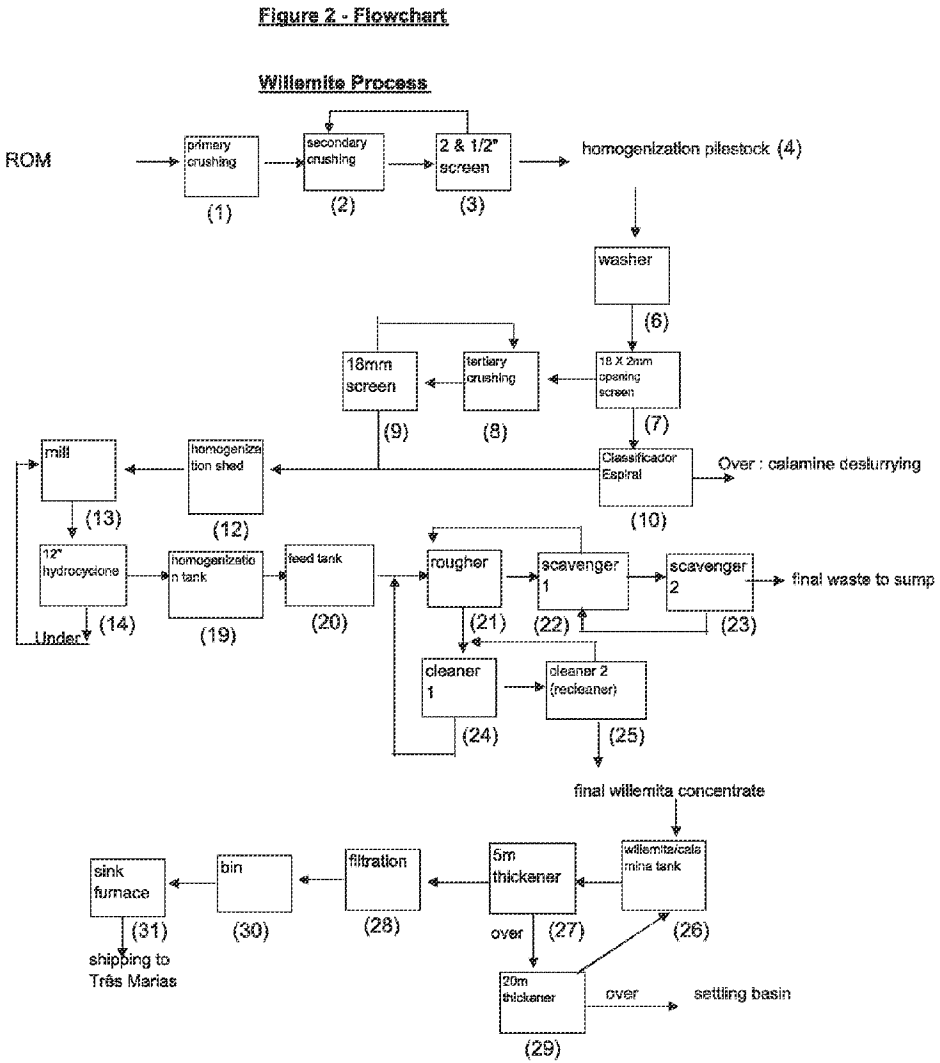
Figure 2 - Flowchart
Willemite Process
ROM
primary crushing
(1)
secondary crushing
(2)
2 & 1/2" screen
(3)
homogenization pilestock (4)
washer
(6)
18 X 2mm opening screen
(7)
tertiary crushing
(8)
18mm screen
(9)
Classificador Espiral
(10)
Over : calamine desturrying
homogenization shed
(12)
mill
(13)
12" hydrocyclone
(14)
Under
homogenization tank
(19)
feed tank
(20)
rougher
(21)
scavenger 1
(22)
scavenger 2
(23)
final waste to sump
cleaner 1
(24)
cleaner 2 (recleaner)
(25)
final willemita concentrate
willemitacate mina tank
(26)
5m thickener
(27)
over
20m thickener
(29)
over
settling basin
filtration
(28)
bin
(30)
sink furnace
(31)
shipping to Três Marias

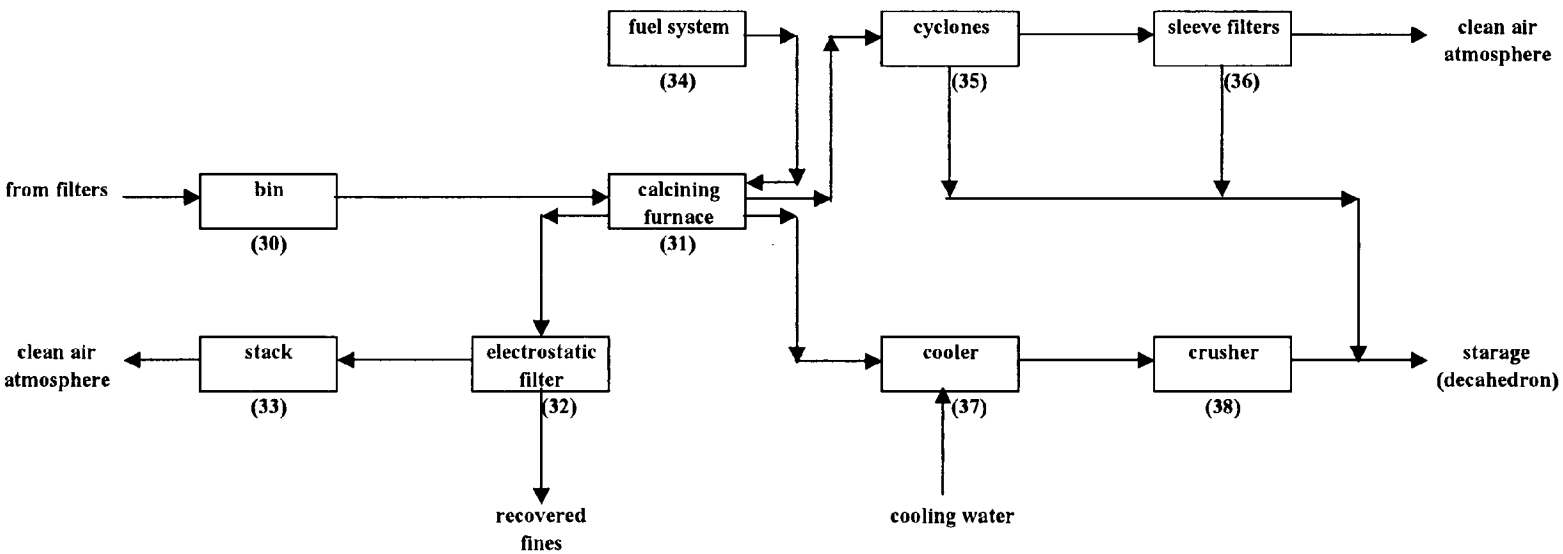
Figure 3 - Calcining - block diagram

CONCENTRATION/CALCINATION PROCESS OF ZINC SILICATED MINERALS AND CONCENTRATE ZINC SILICATE BASED PRODUCT

This invention deals with the concentration process of zinc silicated minerals, particularly the willemite and calamine concentration conducted by single operations or conventional steps of ore treatment, some of which include the following: The preparation of stockpiles with different mineralogical and contents compositions, crushing, screening, storage, dense separation, washing, homogenization, magnetic separation, grinding, classification, rubbing, conditioning, flotation, thickening, filtering, calcination, storage and waste deposition.

This invention deals with product and concentration/calcination process of zinc silicated minerals, particularly willemite and/or calamine, prior to hydrometallurgical processing, i.e., beneficiation of the ore to treat using hydrometallurgical processes.

Willemite is a zinc silicate, $Zn_2SiO_4$, that sometimes contains manganese and is found in the form of prismatic crystals or grained masses, often yellowish green, sometimes white, brown, or red. Investigation has found that willemite is an ore formed from the metamorphism of other secondary ores: Smithsonite and hemimorphite. The latter is also known as calamine. Calamine or hemimorphite—a hydrated zinc basic silicate, $Zn_4Si_2O_7(OH)_2H_2O$—is found in the form of white silicate, which is one of the most important zinc ores. Smithsonite, on the other hand, is a mineral that is formed from modified sphalerite, Zn S, known in nature in the form of zinc carbonate ($ZnCO_3$).

The concentration processes of zinc ores are well known. One of such processes, referred to as the "dense process," will benefit willemite with 20 percent of zinc, and the other, the "volatilization process," will convert calamine into oxide starting from 12 percent of zinc to nearly 50 percent of zinc in Waelz oxide (known because of the process using a Waelz kiln). The dense process is limited in terms of production, granulometry and recovery, and it will only treat high content willemite. In connection with Waelz kilns, in addition to production limits and because it will only treat calamine, it is highly costly, notwithstanding its increased output.

The Petitioner has developed a concentration/calcination process of zinc silicated minerals with single, unique, new characteristics in that it will make beneficiation uniform regardless of the ores to be treated and under which both ores may be treated either individually or mixed and higher output and efficiency may be achieved—over 85 percent with flotation—at lower final beneficiation costs. Depending on the willemite content to be treated, over 20 percent of zinc, the dense process may be used as a supplement of the flotation process. In addition to joint flotation, the process will require calcination for removal of flotation reagents and organic materials that form frothing in hydrometallurgy, resulting in production and efficiency losses of the cathode.

The Petitioner has developed a concentration/calcination process of zinc silicated minerals that is characterized by the following stages, as shown in the block diagrams attached herewith (FIGS. 1, 2, 3 and 4):

(a) crushing (1) (2): Crushing to diminish ore block diameters from nearly 560 to 38 mm for calamine and nearly 560 to 15 mm for willemite; alternately, the ore may pass through scalp previously.

(b) screening (3) (7) (9): In open and closed circuit with crushing, to preferentially feed grinding 100 percent shorter than nearly 60 mm to nearly 15 mm in diameter of the ore to be treated.

(c) storage (4) (5) and dense separation, optional: Using revolving drum and sieve.

(d) washing (6): Conventional, under which unders from the trommel are directed to spiral classifiers (10) and from here lump, along with materials caught by the screen (3) (7) (9), are directed to grinding (13) and classification (14) and fines to deslurrying (15), and, alternately, to homogenization and magnetic separation.

(e) grinding (13): Granulometry material is obtained at nearly 80 to 100 percent under 210 microns, that may be directed to rubbing or flotation, or may be deslurried, lump from hydroclone is fed into flotation, and fines are directed to a sump; alternately, sieve lump (7) may be directed to the sieve (9) for further crushing (8) and a new classification.

(f) deslurrying: Primary (15), secondary (16), tertiary (17), quaternary (18).

(g) rubbing (as appropriate): Of pulp, using equipment operating at around 1500 rpm with 50 to 75 percent pulp weight solids for 30 to nearly 60 minutes.

(h) conditioning and additive addition (19) (20): Ore pulps receive additives prior to flotation, firstly pH modifiers, activators, then collectors, frothers, and alternately, dispersants and others.

(i) flotation (21) (22) (23) (24) (25): The pulp may undergo, alternately, one or more magnetic separation stages, before, during or after flotation, which may be conducted on conventional or column cells, consisting of one or more rougher stages (21), two or more scavengers stages (22) (23), and one or more cleaner stages (24), and cleaner scavengers (25).

(j) thickening (27): Concentrates from the different ores were joined to form the final concentrate, which is pumped into one or more thickeners (27), where it receives one or more flocculants at an amount that may range from around 15 to 50 g/t of dry concentrate.

(k) filtering (28): Thickener underflow (27) is filtered and the overflow, after thickening (29), forms an underflow, filtering, and an overflow that is settled on the fine concentrate sump. The cake is directed to calcination (31).

(l) calcination (31): The wet cake is fed at a rate that may range from around 500 to 750 t/day wet on the furnace, inner temperature ranging from around 500 to 1000° C. at the hot zone.

(m) storage.

1. As shown in FIG. 1 and FIG. 2 attached herewith, crushing (1) (2) (8) is conducted using crushers of the jaw, revolving, roller, hammer, or other type, capable of reducing the 1 m ore blocks to nearly 6.5 mm. Crushers of the jaw, revolving, roller, hammer or other type are preferentially used to reduce blocks to the desired diameters, for instance, to reduce approximately 560 mm to 38 mm for calamine and approximately 560 mm to 15 mm for willemite. In order to minimize crusher operation, a vibrating or fixed grid may be mounted before the crusher as a scalp for the material lower than the desired size. Screenings (3) (7) (9) are conducted using vibrating or bend horizontal screens with square, circular, rectangular, or oblong openings; square screens are preferred for approximately 3 to 0.25 inch openings. The material is crushed (1) (2) (8), screened (3) (3) (7) in open and closed circuit to feed grinding (13) 100 percent shorter than nearly 38 mm for calamine and nearly 18 mm for willemite. Next, the crushed calamine ore (FIG. 1) is washed in a revolving drum (6) and conventional sieve (7) with 2 mm screen, the unders from washer trommel are gravity discharged into the spiral classifier (10), from which overs, along with materials caught by the screen (7), are directed to the grinding bin (12) and grinding (13); unders from 2 mm screen are pumped into washer feed. Fines from spiral classifier are directed to secondary deslurrying (16), from which lump is directed to tertiary deslurrying (17), from which lump travels to the quaternary one (18). Fines from tertiary deslurrying may be recycled or dumped into mud sumps, along with fines from quaternary deslurrying (18), for reuse later. Calamine ore deslurrying may be conducted in two or more stages for fines harmful to flotation to be discarded; this is made using 6" to 1" hydroclones, with $d_{50}$ ranging from 5 microns to nearly 0.5 microns, depending on the ore, or even using microscreens.

Likewise, willemite, depending on the ore, will pass through this same washing process (6) and deslurrying for removal of fines harmful to flotation. Willemite ore (FIG. 2) is wet classified on the two-deck 18 mm and 2 mm sieve, and lump larger than 18 mm is re-crushed by the tertiary crusher (8), dry closed with a 18 mm sieve (9); fines, 2 mm unders, are gravity discharged into the spiral classifier (10), which underflow is directed by a belt conveyor to the pile along with those shorter than 18 mm from the sieve (9); the overflow is pumped into the secondary calamine deslurrying (16). Only washing is usually performed, which fines are joined with those of calamine at the secondary deslurrying (16). These fines go through grinding (13) and/or rubbing (optional), as needed, depending on the appearance of the ore mineral surface. It is worth noting that, if fines are not present, the washing line part will not be used, and the ore will be directly conveyed to the dry sieve (7), using the same recrusher (8) screen deck (9). Additionally, depending on the ore, wire or plastic screen may be used with 12 to 25 mm mesh.

For grinding (13) ore, dry or wet autogenous, half-autogenous, or revolving, bar and/or ball, roller, vibrating, tower or vertical, or pendulum mills may be used in closed or open circuits, with spiral classifiers or hydroclones (14), or vibrating screens, the use of revolving ball mill (13) in closed circuit with hydroclones is preferred. The granulometry of the material produced by grinding is nearly 90 percent under 210 microns for both willemite and calamine. For willemite (FIG. 2), grinding output will often directly feed rubbing (optional) or flotation (21); for calamine (FIG. 1), this product is deslurried with lump from hydroclone (14), and feeds flotation (21); fines are directed to sump. Next, depending on the presence of clay film and/or iron oxide and/or other materials on willemite or calamine mineral surfaces, the pulp is rubbed using an attrition equipment operating at around 1500 rpm, with nearly 50 to 75 percent pulp weight solids, for 30 min to nearly 60 min. Depending on the ore, a flotation operation may be conducted, as appropriate, using a unit cell that is stirred by compressed air or an stirring mechanism on the grinding hydroclone underflow (14), for both calamine and willemite; in this case the reagents are the same, the concentrate from this flotation will be pumped into the flotation circuit and the waste will be recycled to the mill (13) to form its circulating load.

Calamine ore deslurrying is conducted in two to four stages for fines harmful to flotation to be discarded; this is made using 12" to 1" hydroclones, with $d_{50}$ ranging from 5 microns to nearly 0.5 microns, depending on ore, or even using microscreens; use of four deslurrying operations is preferred, with hydroclones in 5" or 6", 4" or 5", 1" or 2" and 1" or 2" diameters for primary (15), secondary (16), tertiary (17) and quaternary (18) deslurrying respectively.

Likewise, willemite ore, depending on its origin, is previously deslurried or washed (6), as described earlier, at the tertiary crushing for fines to be discarded, 100 percent under nearly 0.5 microns using equipment similar to that of calamine. Dense concentration is conducted as needed, with an intermediate medium consisting of ferrosilicon or magnetite pulp, or mixes of dense liquids to form the intermediate density between the density of willemite or calamine particles and the gangue ones; use of ferrosilicon pulp is preferred Likewise, the pulp is subjected, as needed, to one or more magnetic separation stages, before, during or after flotation, by using wet or dry low, mid, or high intensity magnetic field separators and variable gradients with the quantity of diamagnetic ores; use of wet low intensity separators is preferred.

Prior to flotation, willemite and calamine ore pulps receive reagents and are contained in conventional stirring tanks (19) (20) for 1 min to 60 min, depending on the ore. Such pH modifiers and activators are used as sodium, potassium, barium, or ammonia sulfides purely or mixed, with or without caustic soda and/or sodium carbonate; the consumption of sulfide ranges from nearly 1500 to nearly 4000 g/t of dry ore for willemite and nearly 2500 to nearly 5000 g/t of dry ore for calamine, where 2000 to 3000 g/t for willemite and 3000 to 4500 g/t of calamine is consumed preferentially; more preferentially, 2200 to 2700 g/t for willemite and 3400 a 4100 g/t for calamine is consumed.

Preferentially, sodium carbonate is used for consumption of nearly 800 g/t of dry ore to nearly 1500 g/t of willemite dry ore and nearly 1200 g/t of dry ore to nearly 2000 g/t of calamine ore. Pulp pH will change based on the ore, and may range from nearly 10 and 12.5 for willemite and calamine.

Next, the pulp is contained again and receives one or more collectors that may be primary, or secondary amines, or mixes thereof, in varying proportions and depending on the ore, and may range from 180 to 350 g/t of dry ore for willemite and of 300 a 500 g/t of dry ore for calamine. Next, the pulp receives one or more frothers that may be aliphatic alcohols, preferentially methyl isobutyl carbinol or similar, which consumption ranges from 20 to 60 g/t of willemite or calamine dry ore, 30 to 50 g/t of willemite or calamine dry ore being preferred.

Because it consists of finer grains, the calamine pulp receives one or more dispersants such as sodium hexametaphosphate or similar in varying proportions from nearly 150 to nearly 400 g/t of dry ore; 200 to 350 g/t of dry ore is preferred.

Calamine flotation is conducted on conventional or column cells consisting of one rougher (21), two scavengers (22) (23) and one cleaner (24) stage. Scavengers concentrates are recirculated, from the second to the first one and then to the rougher cells. Waste from the last scavenger will form calamine waste, that is directed to the sump. The rougher concentrate is fed into the cleaner cell, which waste is recirculated into the rougher feed. The cleaner concentrate will form calamine concentrate. Willemite flotation consists of two circuits, one for breakdown, rougher (21) and scavenger (22), the other for cleaning, cleaner (24) and cleaner scavenger (25). The cleaner waste is recirculated into the rougher feed. The concentrate scavenger recirculates into the rougher feed. The cleaner concentrate will form willemite concentrate. The willemite flotation control panel is provided with a PLC electronic system to monitor the operation of the cells of both willemite lines.

Willemite and calamine concentrates are joined in a tank (26) to form the final concentrate that is pumped into one or more thickeners (27), where one or more flocculants are added that may be, for instance, polyacrylamide or similar, in proportions of about 15 to 50 g/t of dry concentrate; thickener underflow (27) is filtered (28) by press type rotary vacuum drum, disc, table filters, the revolving drum being preferred. Overflow is gravity discharged to the thicker (29), that may receive filter medium wash water and powder depletion pulp from the calcining furnace pile (refer to FIG. 3 attached herewith); thickener underflow (29) is pumped into the concentrate mix tank (26), and the overflow is recycled at the willemite conditioner (20) outlet and/or settled on the sump (basin) of fines for future reuse. The filter (28) forms two products: The filtered material that is sent back to thickening (29) and the cake that is directed to calcination (31). The calcining process (31), as shown in FIG. 3 attached herewith, consists of a revolving furnace (31), fan (35) and electrostatic filter (32) for recovery of exhaust gas fines, stack (33), cyclones (35), sleeve filters (36), cooler (37), crusher (38), BPF oil heater assembly (34), BPF oil storage/supply system, burning torch system, vapor generation system. The wet cake (with 12 to 16 percent of water) is fed at a rate that ranges from 500 to 850 t/day wet, on the revolving furnace (31), inner temperature ranging from 500 to 1200° C. at the hot zone. Organic materials and water after burned are sucked at the other end of the furnace to the stack through the electrostatic filter for recovery of fines. The calcine concentrate produced at the other end of the furnace (31), where the torch is placed, is gravity discharged into the cooler (37), and receives water to decrease temperature from nearly 600° C. to nearly 80° C., then alternately to a crusher. To improve calcined quality the furnace discharge zone is sucked by blowing air and then cycloning (35), where two products are generated: Lump that is settled as final product and fines that are directed to the sleeve filter (36) along with air. The sleeve filter product joins the lump from the cyclone by way of a rotary valve; clean air is ousted by the filter stack. Most of the produced concentrate is discharged through the cooler into the crusher, that may be of the roller, jaw, or hammer type; the latter is preferred in order to reduce any sticks in the calcined material. From the crusher discharge the calcined material is carried by a bucket hoist to a storage shed where a lower discharge reset and belt conveyor system loading into trucks is conducted. Calcine concentrate humidity ranges from nearly 3 to 7 percent and is formed at the final product of the whole process. BPF type 2A oil is used for the furnace—type up to 7A may also be used. Depending on local conditions other fuels may be used, where available: charcoal or coal, hard coke and others. For both storage and use of oil 2A, a vapor generation system is provided, BPF oil boilers as well, for control of viscosity and temperature around 65° C., and maintenance of storage and pumping into the daily tank. Next, the oil is heated by electric resistances to 150° C. and is pumped 18 kgf/cm$^2$ pressure. This temperature and pressure are kept automatically for setting the torch. The heated pressurized oil is mixed on the torch with vapor at 9 to 11 kgf/cm$^2$ pressure for atomization and composition of the flame that is adjusted by primary air that is subdivided into two inlets, radial and axial air. An automatic control is provided for depression of furnace hot and cool interdependent zones that are linked to the temperatures in the smoke chamber and electrofilter outlet so as to keep the temperature at the electrofilter inlet as high as possible. To increase or diminish depressions at the fan inlet a wide range lattice valve is mounted before the fan. Operating peripherals such as automatic uncloggers, temperature, pressure and other controls are provided all along the furnace circuit. The main CO and $O_2$ is monitored by an automatic control at the electrofilter inlet, that is provided with relief doors to check for CO buildup at safety levels. Before the electrofilter a combustion gas cooling tower is provided that may be bypassed where increased temperature is desired. The furnace control panel is provided with a PLC to automatically control each operation. Furnace revolution may range from 0 to 5.0 rpm, 1.0 rpm being the most usual. In addition to the main motor and auxiliary diesel motor is provided to guarantee power supply.

The final moisture content of the final product based on concentrate zinc silicates ranges from nearly 3 to 7 percent and zinc contents from nearly 42 to 47 percent in mass.

The following are examples illustrating the invention that should not be taken as a reference for purposes of restricting the patent.

EXAMPLE 1

Willemite ore was fed at a rate of 120 t/h on the primary crusher, then on the secondary crusher, closed with 2½" vibrating screen with, piled 100 percent under this size, then reloaded to feed the washer, and received water, then screened at washer outlet for removal of the fines that have been pumped into the 2$^{nd}$ calamine deslurrying. Lump from the washer was dry re-crushed in closed circuit with the 15 mm vibrating screen and tripper homogenized on the homogenization pile. Next, it was reloaded at a rate of 80 t/h, equally divided into two grinding circuits operating with hydroclones to produce pulp with 95 percent under 65 mesh Tyler. Solids were set to 32 weight percent in the product. Next, pulp was conditioned and pH activator and regulator was added in proportions of 1520 g/t and 196 g/t of collector, to feed two identical flotation lines, which circuit was described earlier, where further reagents, 940 g/t of sulfide, 40 g/t of frother and 90 g/t of collector were added. The final concentrate with 43.5 percent of zinc contents was directed to filtration along with the calamine one.

Calamine ore was fed at a rate of 120 t/h on the primary crusher, then on the secondary crusher, closed with a 1½" vibrating screen, piled 100 percent under this size, then reloaded to feed the washer at a rate of 37.4 t/h, received water, was screened at the washer outlet to feed the spiral classifier and deslurrying operations as described earlier. Slump from the washer (13.8 t/h) and spiral classifier (11.3 t/h) were directed to the grinding circuit, closed with hydroclone to be cut down 100 percent shorter than 65 mesh Tyler. The fines from the spiral classifier (12.3 t/h) and willemite slurry mud (3 t/h) were directed to 5" hydroclones of the secondary deslurrying at 2 to 2.5 kgf/cm$^2$ pressure, the underflow of which (11.4 t/h) being directed to the conditioning tank and the overflow gravity directed to the recovery sump for future processing in tertiary and quaternary deslurrying operations. The grinding hydroclone overflow (12.6 t/h) was pumped at 2 to 2,5 kgf/cm$^2$ pressure to the primary deslurrying hydroclones, which overflow was directed the secondary deslurrying (25.1 t/h) and its underflow(18.3 t/h) was joined with the product from the secondary deslurrying, then both were finally conditioned and received reagents, dispersant at 277 g/t, activator at 2000 g/t, collector at 150 g/t and frother at 40 g/t. The flotation circuit is as described earlier, except that in this example no rougher concentrate cleaning was used, which, alone, had 38 percent of zinc. Zinc recovery up to flotation for willemite was 81 percent and 72 percent for calamine in connection with the fed zinc. Next, both concentrates were mixed and filtered, resulting in contents of 42 percent of zinc and production of 22.8 t/h and 15 percent of cake moisture. Next, this concentrate was calcined along with the concentrate stored at the filtering house, resulting in calcine concentrate with 44.5 percent of zinc, final recovery of 78 percent, 5 percent moisture. This concentrate was directed to metallurgy for production of metallic zinc.

EXAMPLE 2

FIG. 4 attached herewith illustrates the operation of a simplified calamine and/or willemite beneficiation plant.

At first, both calamine and willemite beneficiation plants are separated. The single operations in the stages of crushing, washing, grinding and flotation are shown for both calamine and willemite. Flotation wastes from both calamine and willemite are collected and directed to the waste sump or settling basins for recycling of mud. Concentrates from the flotation step for both calamine and willemite are joined in the final homogenization tank of willemite from the flotation step, then the resulting mix is directed to common stages of filtration and calcination.

The invention claimed is:

1. Concentration/calcination process of different zinc silicated minerals wherein the different zinc silicated minerals include both calamine and willemite ores and the process includes separately treating the calamine ore and the willemite ore in stages (a) through (i) below and joining the concentrates in stage (j), the process further comprises, (a) crushing (1) (2) the ore to diminish ore block diameters of the ore to around 560 to 38 mm for calamine and around 560 to 15 mm for willemite;

(b) screening (3) (7) (9) the ore blocks in open or closed circuit with crushing to feed grinding at 100 percent shorter than around 60 mm to around 15 mm in diameter of the ore to be treated;

(c) optionally storing the ore (4) (5) and optionally subjecting the ore to dense separation using a revolving drum and sieve;

(d) washing (6) the ore in the trommel washer, in which unders in the trommel washer are directed to spiral classifiers (10), from which spiral overs, along with the materials caught by the screen (7) (9), are directed to grinding (13) and hydrocyclone (14), and spiral fines to deslurrying (15);

(e) grinding (13) to obtain granulometry material is obtained of nearly 80 to 100 percent under 210 microns that is directed to deslurrying by said hydrocyclone, and said hydrocyclone overs being fed to flotation, and said hydrocyclone fines are directed to a sump;

(f) said deslurrying optionally comprising primary (15), secondary (16), tertiary (17), and quaternary (18) deslurrying stages;

(g) optionally rubbing of the deslurried pulp using equipment operating at nearly 1500 rpm with 50 to 75 percent pulp weight solids, for 30 to nearly 60 minutes;

(h) conditioning the deslurried ore pulp by additive addition (19) (20) in which an additive is added to said ore pulps prior to flotation, said conditioning comprises firstly pH modifiers, activators, then collectors, frothers, and optionally, dispersants and others;

(i) subjecting the conditioned pulp to flotation (21) (22) (23) (24) (25) wherein the pulp may optionally be subjected to one or more magnetic separation stages, before, during or after flotation, which may be conducted on conventional or column cells, said flotation comprises one or more rougher stages (21), two or more scavengers stages (22) (23) and one or more cleaner stages (24), and cleaner scavenger (25) thereby forming a concentrates fraction and a waste fraction;

(j) joining the calamine concentrates and the willemite concentrates together to form a final concentrates and subjecting the final concentrates to thickening (27), said thickening comprising pumping said combined concentates into one or more thickeners, where one or more flocculants are added at an amount in the range from around 15 to 50 g/t of dry final concentrate;

(k) filtering (28) wherein the thickener underflow (27) is filtered to form a wet cake, and subjecting the wet cake to calcination (31);

(l) calcination (31) wherein the wet cake is fed at a rate in the range from around 500 to 850 t/day wet, on a calcinations furnace with inner temperature ranging from around 500 a 1200° C. at the hot zone; and (m) storage for the calcined product.

2. Concentration/calcination process of zinc silicated minerals according to claim 1 characterized by the fact that screening in stage (b) may be conducted on two stages: Primary and secondary.

3. Concentration/calcination process of zinc silicated minerals according to claim 1 characterized by the use of crushers of the jaw, revolving, roller, hammer, or other type that is capable of reducing blocks of ore to the desired diameters.

4. Concentration/calcination process of zinc silicated minerals according to claims 3 characterized by using jaw crushers.

5. Concentration/calcination process of zinc silicated minerals according to claim 1 characterized by the fact that screening may be conducted on vibrating or bend horizontal screens with square, circular, rectangular, or oblong openings.

6. Concentration/calcination process of zinc silicated minerals according to claims 1 characterized by the fact that, for willemite ore, fines from spiral classifiers (10) are joined with those of calamine at the secondary deslurrying (16) and these fines only pass through grinding (13) and/or optional rubbing, as needed, depending on the appearance of ore mineral surface.

7. Concentration/calcination process of zinc silicated minerals according to claim 1 characterized by the fact that the ore may be ground using autogenous, half-autogenous, or revolving, bar and/or ball, roller, vibrating, tower or vertical, or pendulum dry or wet mills.

8. Concentration/calcination process of zinc silicated minerals according to claim 1 characterized by the fact that the pulp is subjected to one or more magnetic separation stages, before, during or after flotation, by using wet or dry low, mid, or high intensity magnetic field separators and gradients that vary with the quantity of diamagnetic ores.

9. Concentration/calcination process of zinc silicated minerals according to claim 1 characterized by the fact that calamine deslurrying may be conducted in two or more stages.

10. Concentration/calcination process of zinc silicated minerals according to claim 1 characterized by the fact that, for calamine ore, fines from spiral classifiers (10) may be directed to the secondary deslurrying (16), which overs would travel to the tertiary deslurrying (17), then overs to the quaternary deslurrying (18).

11. Concentration/calcination process of zinc silicated minerals according to claims 10 characterized by the fact that, for calamine, fines from tertiary deslurrying may be recycled or dumped into mud sumps along with fines from quaternary deslurrying (18), for reuse later.

12. Concentration/calcination process of zinc silicated minerals according to claims 1 characterized by the fact that calamine ore deslurrying may be conducted in two or more stages for fines harmful to flotation to be discarded, using 6" to 1" hydroclones with $d_{50}$ ranging from 5 microns to nearly 0.5 microns depending on the ore, or even using micro-screens.

13. Concentration/calcination process of zinc silicated minerals according to claims 1 characterized by the fact that the four deslurrying stages in stage (f) are used preferentially, with hydroclones in 5" or 6", 4" or 5", 1" or 2" and 1" or 2" diameters for the primary, secondary, tertiary and quaternary deslurrying stages respectively.

14. Concentration/calcination process of zinc silicated minerals according to claim 1 characterized by the fact that willemite ore, depending on its origin, is previously deslurried or washed, as described earlier, at crushing, to discard fines 100 percent under nearly 0.5 microns using equipment similar to that of calamine.

15. Concentration/calcination process of zinc silicated minerals according to claims 6 characterized by the fact that dense separation is conducted, as needed, with an intermediate medium consisting of ferrosilicon pulp, or magnetite, or mixes of dense liquids to form the intermediate density between the density of willemite or calamine particles and the gangue ones.

16. Concentration/calcination process of zinc silicated minerals according to claims 8 characterized by the fact that low intensity wet separators are used preferentially.

17. Concentration/calcination process of zinc silicated minerals according to claim 1 characterized by the fact that the willemite and calamine ore pulp is contained in conventional stirring tanks for 1 min to nearly 60 min in stage (h).

18. Concentration/calcination process of zinc silicated minerals according to claim 1 characterized by the fact that flotation may be conducted using an unit cell that is stirred by compressed air or stirring mechanism.

19. Concentration/calcination process of zinc silicated minerals according to claim 1 characterized by the use of pH modifiers selected from pure or mixed sodium, potassium, barium, or ammonium sulfides with caustic soda and/or sodium carbonate.

20. Concentration/calcination process of zinc silicated minerals according to claim 19 characterized by the use of the sulfides at around 1500 to around 4000 g/t of dry ore for willemite and around 2500 up to 5000 g/t of dry ore for calamine.

21. Concentration/calcination process of zinc silicated minerals according to claim 19 characterized by the use of the sulfides at around 2000 to around 3000 g/t of dry ore for willemite and around 3000 to 4500 g/t of dry ore for calamine.

22. Concentration/calcination process of zinc silicated minerals according to claim 19 characterized by the use of the sulfides at around 2200 to around 2700 g/t of dry ore for willemite and around 3400 to 4100 g/t of dry ore for calamine.

23. Concentration/calcination process of zinc silicated minerals according to claim 19 characterized by the use of sodium carbonate at a consumption of nearly 800 g/t of dry ore to nearly 1500 g/t of willemite dry ore and nearly 1200 g/t of dry ore to nearly 2000 g/t of calamine ore.

24. Concentration/calcination process of zinc silicated minerals according to claim 1 characterized by the addition of pH modifier until pH of nearly 10 to 12.5 is approximately obtained for willemite and calamine.

25. Concentration/calcination process of zinc silicated minerals according to claim 1 characterized by the use of a collector reagent selected from the group of the primary, or secondary amines, or mixes thereof, in varying proportions and depending on the ore, and range from 180 to 250 g/t of dry ore for willemite and 300 to 500 g/t of calamine dry ore.

26. Concentration/calcination process of zinc silicated minerals according to claim 1 characterized by the use of frother selected from the aliphatic alcohol group, at a consumption of nearly 20 to 60 g/t of willemite or calamine dry ore.

27. Concentration/calcination process of zinc silicated minerals according to claim 1 characterized by the use, as frother, of methyl isobutyl carbinol in an amount of nearly 30 to 50 g/t of willemite or calamine dry ore.

28. Concentration/calcination process of zinc silicated minerals according to claim 1 characterized by the fact that a dispersant is used in proportions varying from nearly 150 to nearly 400 g/t of dry ore.

29. Concentration/calcination process of zinc silicated minerals according to claim 28 characterized by the use, as dispersant, of sodium hexametaphosphate, in proportions varying from nearly 200 to nearly 300 g/t of dry ore.

30. Concentration/calcination process of zinc silicated minerals according to claim 1 characterized by the fact that, for calamine, ore scavengers concentrates are recirculated, the latter scavenger stage (23) to the former scavenger stage (22) and from the former scavenger stage (22) to the rougher stage (21); the waste from the last scavenger (23) will form calamine waste that is directed to the sump, the rougher concentrate is fed into the cleaner stage (24), which waste therefrom is recirculated into the rougher feed; and the cleaner concentrate will form the calamine concentrate.

31. Concentration/calcination process of zinc silicated minerals according to claim 1 characterized by the fact that willemite flotation consists of two circuits, one of which is breakdown, rougher (21), scavenger (22) and the other is cleaning, cleaner (24) and cleaner scavenger (25); the cleaner waste is recirculated into the rougher feed, the scavenger concentrate recirculates into the rougher feed; and the cleaner concentrate will form the willemite concentrate.

32. Concentration/calcination process of zinc silicated minerals according to claim 1 characterized by the fact that willemite and calamine concentrates are joined in a tank (26) to form the final concentrate which is pumped into one or more thickeners (27), where one or more flocculants are added.

33. Concentration/calcination process of zinc silicated minerals according to claim 1 characterized by the use, as flocculant, of polyacrylamide, in proportions of nearly 15 to 50 g/t of dry concentrate.

34. Concentration/calcination process of zinc silicated minerals according to claim 1 characterized by the fact that the thickener underflow (27) is filtered (28) and the overflow is gravity discharged to a thickener (29), that may receive a filter medium wash water and a powder depletion pulp from calcining furnace pile.

35. Concentration/calcination process of zinc silicated minerals according to claims 34 characterized by the use, as filters, of press type rotary vacuum drum, disc, table filter, and revolving drum filter.

36. Concentration/calcination process of zinc silicated minerals according to claim 34 characterized by the fact that the thickener underflow (29) is pumped into a concentrate mix tank (26) and the overflow is recycled at a conditioner outlet (20) and/or settled on the sump of fines for future reuse.

37. Concentration/calcination process of zinc silicated minerals according to claim 34 characterized by the fact that the filter (28) forms two products, a filtered one that is directed again to thickening (29) and the cake that is directed to calcination (31).

38. Concentration/calcination process of zinc silicated minerals according to claim 1 characterized by the use, as calcining system (31) of revolving furnace (31), fan (35), electrostatic filter (32) for recovery of exhaust gas fines, stack (33), cooler (37), sleeve filters (36), crusher (38), BPF oil heater assembly (34), BPF oil storage/supply system, burning torch system, vapor generation system.

39. Concentration/calcination process of zinc silicated minerals according to claim 1 characterized by the fact that the wet cake is wet fed at a rate that ranges from around 500 to 750 t/day, into the furnace (31), which inner temperature ranges from around 500 to 1000° C. at the hot zone.

40. Concentration/calcination process of zinc silicated minerals according to claim 38 characterized by the fact that after calcination, organic materials and water, after burned, are sucked at the other end of the furnace (31) to the stack (33) through the electrostatic filter (32) for recovery of fines; the calcine concentrate that is produced from furnace (31) discharged into the cooler (37), and water may be added to reduce the temperature; and the calcine concentrate is then directed to the crusher (38).

41. Concentration/calcination process of zinc silicated minerals according to claim 38 characterized by the fact that, to improve calcined quality, the furnace discharge zone may be sucked by blowing air and then cycloning (35), where two products are formed: Overs settled as final product and fines along with the air travel to the sleeve filter (36); the sleeve filter product joins the cyclone lump by way of a rotary valve; and clean air is ousted by the filter stack (33).

42. Concentration/calcination process of zinc silicated minerals according to claim 1 characterized by the fact that filtering (28) may be conducted using a press type rotary vacuum drum, disc, table filters, and a revolving drum.

43. Concentration/calcination process of zinc silicated minerals according to claim 1 characterized by the fact that an oil, charcoal, coal, or other furnace is used as the calcinations furnace.

* * * * *

UNITED STATES PATENT AND TRADEMARK OFFICE

CERTIFICATE OF CORRECTION

PATENT NO. : 7,172,074 B2
APPLICATION NO. : 10/466978
DATED : February 6, 2007
INVENTOR(S) : Julio Cesar Bittencourt It is certified that error appears in the above-identified patent and that said Letters Patent is hereby corrected as shown below:

Cover Page, Section (73), “Assignee: Compamhia Mineira de Metals” should read --Assignee: Companhia Mineira de Metals--.
Col. 3, line 16, “hydroclones” should read --hydrocyclones--.
Col. 3, line 44, “hydroclones” should read --hydrocyclones--.
Col. 3, line 49, “hydroclone” should read --hydrocyclone--.
Col. 3, line 58, “or an stirring mechanism on the grinding hydroclone” should read --or a stirring mechanism on the grinding hydrocyclone--.
Col. 3, line 65, “hydroclones” should read --hydrocyclones--.
Col. 4, line 1, “hydroclones” should read --hydrocyclones--.
Col. 4, line 13, “preferred” should read --preferred.--.
Col, 4, line 32, “3400 a 4100” should read --3400 to 4100--.
Col. 4, line 41, “300 a 500” should read --300 to 500--.
Col. 5, line 10, “thicker” should read--thickener--.
Col. 6, line 13, “motor, and auxiliary” should read --motor, an auxiliary--.
Col. 6, line 34, “hydroclones” should read --hydrocyclones--.
Col. 6, line 42, “calamine one.” should read --calamine ore.--.
Col. 6, lines 50-51, “hydroclone” should read --hydrocyclone--.
Col. 6, line 53, “hydroclones” should read --hydrocyclones--.
Col. 6, line 58, “hydroclone” should read --hydrocyclone--.
Col. 6, line 59, “2 to 2,5” should read --2 to 2.5--.
Cal. 6, line 60, “hydroclones” should read --hydrocyclones--.
Col. 6, line 61, “directed the secondary” should read --directed to the secondary--.
Col. 7, lines 49-50, “material is obtained” should read --material obtained--.
Col. 8, line 32, “claims 3” should read --claim 3--.
Col. 8, line 40, “claims 1” should read --claim 1--.
Col. 9, line 2, “claims 10” should read --claim 10--.
Col. 9, line 7, “claims 1” should read --claim 1--.
Col. 9, line 10, “hydroclones” should read --hydrocyciones--.
Col. 9, line 14, “claims 1” should read --claim 1--.
Col. 9, line 16, “hydroclones” should read --hydrocyclones--.
Col. 9, line 26, “claims 6” should read --claim 6--.
Col. 9, line 33, “claims 8” should read --claim 8--.
Col. 9, line 41, “using an unit cell” should read --using a unit cell--.

UNITED STATES PATENT AND TRADEMARK OFFICE

CERTIFICATE OF CORRECTION

PATENT NO. : 7,172,074 B2
APPLICATION NO. : 10/466978
DATED : February 6, 2007
INVENTOR(S) : Julio Cesar Bittencourt It is certified that error appears in the above-identified patent and that said Letters Patent is hereby corrected as shown below:

Col. 10, line 63, “claims 34” should read --claim 34--.

Signed and Sealed this

Sixth Day of November, 2007

JON W. DUDAS
*Director of the United States Patent and Trademark Office*